US006032440A

United States Patent [19]

Lüdtke

[11] Patent Number: 6,032,440

[45] Date of Patent: Mar. 7, 2000

[54] TENSIONING DEVICE FOR HOOP-CASING MACHINES

[75] Inventor: Peter Lüdtke, Eberbach, Germany

[73] Assignee: Mashinenfabrik Gerd Mosca GmbH, Waldbrunn, Germany

[21] Appl. No.: 09/116,842

[22] Filed: Jul. 16, 1998

[30] Foreign Application Priority Data

Jul. 16, 1997 [DE] Germany ..... 197 30 449

[51] Int. Cl.[7] ..... B65B 13/04

[52] U.S. Cl. ..... 53/589; 100/32

[58] Field of Search ..... 53/589, 389.4, 53/582; 100/32, 29, 33 PB

[56] References Cited

U.S. PATENT DOCUMENTS

| | | | |
|---|---|---|---|
| 4,218,969 | 8/1980 | Kasuga | 100/32 |
| 4,625,500 | 12/1986 | Huber | 53/589 |
| 4,683,017 | 7/1987 | Figiel et al. | 53/589 |
| 5,024,149 | 6/1991 | Kato | 53/589 |
| 5,267,508 | 12/1993 | Yoshino | 53/589 |
| 5,459,977 | 10/1995 | Haberstroh | 53/589 |

*Primary Examiner*—Linda Johnson
*Attorney, Agent, or Firm*—Hutchins, Wheeler & Dittmar

[57] ABSTRACT

The invention is a machine for tying up or hooping packing units with an elongated strip of binding material, such as bondable plastic. During operation of the machine, the strip is drawn from a take-up device of a supply roller through a strip conveyor device and a strip guide, then is wound around the packing unit as a loop. The loop is tightened by means of a tensioning assembly comprising a tension roller and a pressing device which presses the strip against the tension roller, such that the loop is placed under tension. Once the packing unit is tightly secured, the strip is sealed by means of a sealing device. The present hoop-casing machine permits a high tension force to be exerted on the strip loop to be sealed. For this purpose, the tension roller comprises on its peripheral surface a high friction surface. At least one rejecter is provided for preventing excess wear on the high friction surface during the tensioning step. The rejecters can be moved between the strip and the friction surface of the tension roller.

16 Claims, 4 Drawing Sheets

TENSIONING DEVICE FOR HOOP-CASING MACHINES

FIELD OF THE INVENTION

The invention concerns a machine for tying up or hooping packing units with a strip, particularly of bondable plastic, which a) is drawn from a take-up device of a supply roll, b) is applied by means of a strip conveyor device and a strip guide as a loop around the packing unit, c) is tensed by means of a tensioning device with a tension roller and a pressing device pressing the strip against the tension roller, whereby the loop that is placed under tension is closed by means of a sealing device.

BACKGROUND

Prior to shipping, it is often desirable to secure a package with a strip of binding material. For this purpose, the package can be placed on a hooping device which automatically loops the binding material around the package, pulls it tightly about the package, then seals it. Machines for hooping or binding packages are known, for example, from DE 195 16 043. In these hoop-casing machines, a plastic strip is "shot" at high velocity into a strip guide by the strip conveyor device in order to form a loop around the packing unit. The end of the strip is collected and fixed by a strip holder. Then, the drive of the strip conveyor device which originally advanced the strip is reversed thereby pulling the loop tightly around the packing unit. The tension roller of the tensioning device, about whose peripheral surface the strip material is wound in a specific angular region, then is driven so that a tension force is exerted on the strip. In this tensed state, the loop is closed by means of a sealing device, such as an ultrasound bonding device or friction welding device. As a rule, during the welding process, a buttress plate is arranged between the strip and the welding head of the welding device, which is withdrawn before transporting the hooped packing unit. For this reason, it is necessary to apply a very high tension force to the strip before it is sealed by the sealing device so that a sufficient strip tension will prevail after the withdrawal of the buttress plate.

It is an object of the invention is to create a hoop-casing machine which can be utilized in a cost-favorable and reliable way and which makes possible the application of a high tension force on the strip loop to be sealed.

SUMMARY OF THE INVENTION

The invention comprises a novel tensioning assembly and a hoop-casing apparatus comprising the device. According to the invention, the tensioning assembly comprises a tension roller comprising a friction surface disposed on a peripheral surface, and at least one rejecter which can be moved between the strip and the friction surface of the tension roller. The rejecter has an application surface which is configured as a smooth sliding surface over which the strip passes.

The friction surface on the peripheral surface of the tension roller comprises a high friction material. The high friction material increases the coefficient of friction between the plastic strip and the tension roller, thus permitting a very high tension force to be transmitted to the strip. The magnitude of the tension force will depend in part on the winding angle, i.e., the angular segment on which the strip is applied against the tension roller and on the pressure force exerted by a pressing device which presses the strip against the tension roller.

The friction surface may comprise any high-friction material, and preferably comprises a rubber-type material. High-friction rubbers which can be used include, for example, natural rubbers, isoprene rubbers, chloroprene rubbers, and polyurethane rubbers. In one preferred embodiment of the invention, the rubber material is Vullkolan® (registered trademark of the Bayer Company). Preferably, the friction surface of the tension roller, which is in contact with strip material, comprises a metal peripheral surface of the tension roller coated with the rubber material. In a preferred embodiment, the friction surface comprises pyramidal shaped projections with sharp tips. The friction surface in this way can penetrate at least partially into the plastic strip holding it more securely, thus ensuring that a high tension force is applied to the strip by the tension roller.

During operation of the hoop-casting apparatus, the strip is projected into a strip guide, looped around the package, then pulled back to create tension on the strip. During the pulling back step, the strip is tightly pulled around the packing unit. The contact between the plastic strip and the friction surface during the rapid strip movement during the shooting and pullback steps may result in high temperatures and considerable material abrasion due to the friction. The rubber-type friction surface may become quickly abraded by the plastic strip. If a metal friction surface is used, the plastic strip may be crushed with the rapid motion, and the abrasion of the machine may cause blockage after a short time of operation. For this reason, at least one rejecter is provided which can be moved between the strip and the friction surface of the tension roller. The rejecter comprises an contact surface comprising a flat sliding surface over which the strip can pass.

The rejecter may be introduced during rapid strip movement during the shooting and pullback steps, whereby the strip slides over the flat sliding surface of the rejecter and has no contact with the friction surface of the tension roller during these steps. For example, the rejecter may comprise steel pins having a smooth cylindrical surface which can be moved between the strip and the tension roller, which can be arranged over the angular region of the tension roller, around which the plastic strip is wound.

Preferably, the rejecter comprises a segment of a cylindrical sleeve which can be moved over the angular region of the tension roller around which the plastic strip is wound. In a particularly preferred embodiment, the rejecter is a cylindrical sleeve attached to a cover disk mounted in a rotatable manner coaxial to the tension roller. This disk can be driven by a rotary drive, for example. The cover disk extends the dimensions of the tension roller arrangement slightly in the axial direction. The rejecter comprising the cylindrical sleeve also causes only a slight increase in the dimensions of the tension roller in the radial direction. This preferred embodiment can be produced with minimal space required, so that the machine according to the invention can be designed in a compact manner.

Preferably, during operation of the machine, the strip is wound around an angular segment of the tension roller at approximately 90°, whereby the rejecter encompasses an angular segment that is at least of the same magnitude.

Another problem may result due to the use of a friction surface on the tension roller when the plastic strip is pressed against the surface by the pressing roller. In particular, when hardened tension rollers with milled pyramidal-shaped surface structures are used, and a pressing roller with a corresponding surface structure is used, the danger exists that the hardened metal tips of the tension roller and the pressing roller will chip in case of direct contact when there is a defect in the plastic strip between the two rollers. A disruption of the surface of the tension roller or the pressing roller may lead to a failure of the machine, and to considerable maintenance expenditure.

This problem can be avoided in the machine of the invention in that a stop element may be provided which, when engaged, can prevent a complete pressing of the pressing roller against the tension roller so that a gap remains between the surfaces of the two rollers. When the stop element is in the released position, e.g., is disengaged, the peripheral surfaces of the tension roller and pressing roller are unhindered from pressing together, and thus the optimal tension force on the strip is produced. For rollers with structured surfaces, it is necessary that the surfaces are pressed against one another with sufficient force that their projections are geared with one another, and can penetrate into the strip disposed between the roller surfaces.

Preferably, a control device is present which brings the stop into the blocking or engaged position if it is determined by means of a strip detection device that the strip is not present between the pressing roller and the tension roller. A simple disconnection of the pressing drive of the pressing roller cannot be produced because, for maintenance purposes, all drives of the machine, including the pressing drive, must be activatable even when the machine is open and the strip is absent. The function of the individual machine components is examined by activating the individual drives by means of separate drive switches with the machine opened. Thus, when testing and activating the pressing drive, the collision of the surfaces of the pressing roller and the tension roller can be avoided when the strip is missing by providing the stop element described above.

Preferably, the stop element is integrated into the same cover disk which bears the rejecter. In this way, the cover disk has an enlarged diameter for forming the stop in the engaged position, and has a reduced diameter in the region in which no stop is provided (the release position). A contact surface, which is rigidly joined with the pressing roller, is applied against this outer peripheral surface of the cover disk.

Preferably, the contact surface is formed by the outer peripheral surface of an annular flange arranged coaxially to the pressing roller, and this flange lies in the same plane as the cover disk of the tension roller.

BRIEF DESCRIPTION OF THE FIGURES

Other features and advantages of the invention result from the following description of the drawings. In the drawings.

DETAILED DESCRIPTION OF THE INVENTION

Figure 1:
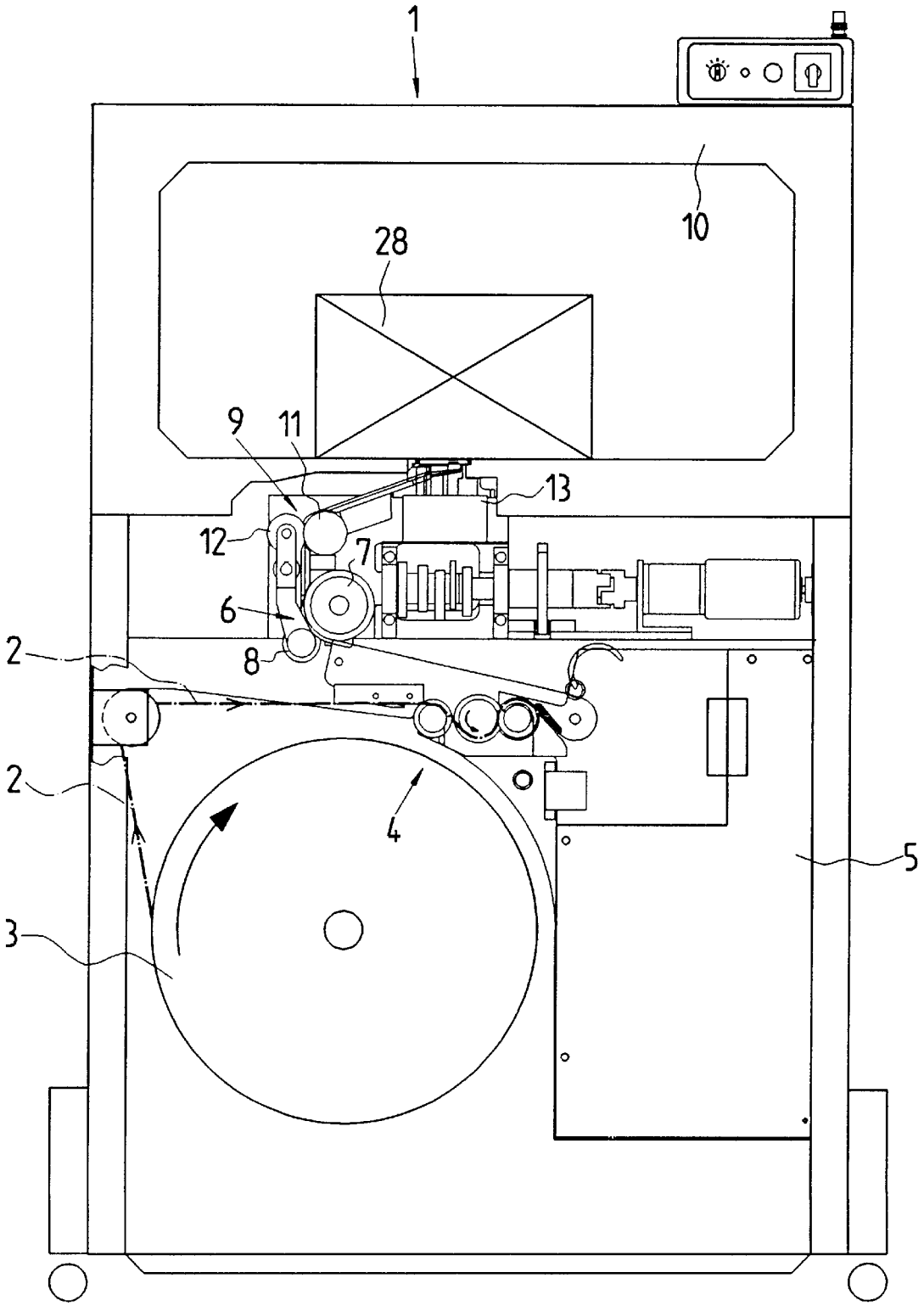
FIG. 1 shows a schematic front view of a hoop-casing machine.

The hoop-casing machine 1 shown in FIG. 1 corresponds to the state of the art as shown in DE 195 16 043 A1, and serves for hooping packing units 28 with a strip 2, which is withdrawn by a take-up device 4 from a supply roll 3 and introduced into a strip magazine 5. From there, by means of strip conveyor device 6, which comprises two drive rollers 7,8 lying opposite one another, the strip is guided through a tensioning device 9 via a strip guide in a strip guide frame 10, so that the strip can form a loop around the packing unit 28. After looping around package 28, the end of the strip is seized by a strip holder (not shown), and then the drive of strip conveyor device 6 is reversed so that the strip loop is pulled out from strip guide frame 10 and pulled tightly around packing unit 28. Tension device 9 comprises a tension roller 11, and a pressing roller 12 that can be pressed against tension roller 11. Tension device 9 is activated whereafter the drive of strip conveyor device 6 is reversed. Upon activation, pressing roller 12 presses strip 2 rigidly against tension roller 11, whereby tension roller 11 is driven in the pullback direction, so that the strip loop is pulled around packing unit 28 with a high tension force. Then, the initial part of the loop is joined with the end of the loop by means of sealing device 13. Typically, sealing device 13 comprises an ultrasonic or friction bonding or welding device, which bonds the initial part and the end part of the loop, however, any sealing means can be used. The binding strip preferably comprises a bondable plastic material, capable of melt bonding to form a secure seal. Such materials are well known and do not form a part of this invention.

Figure 2:
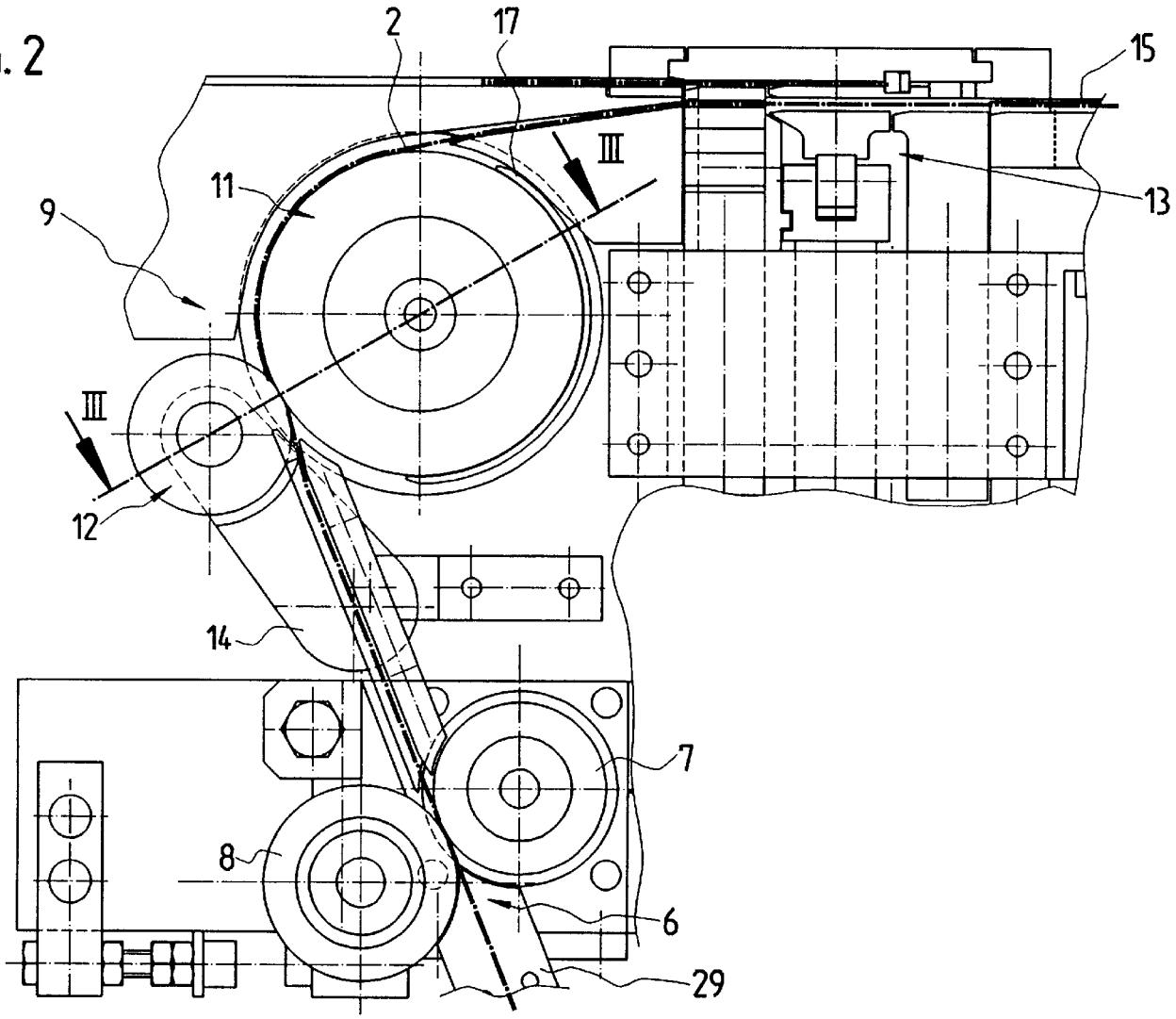
FIG. 2 shows an enlarged representation of the strip conveyor device and the tensioning device of the machine in front view.
Figure 3:
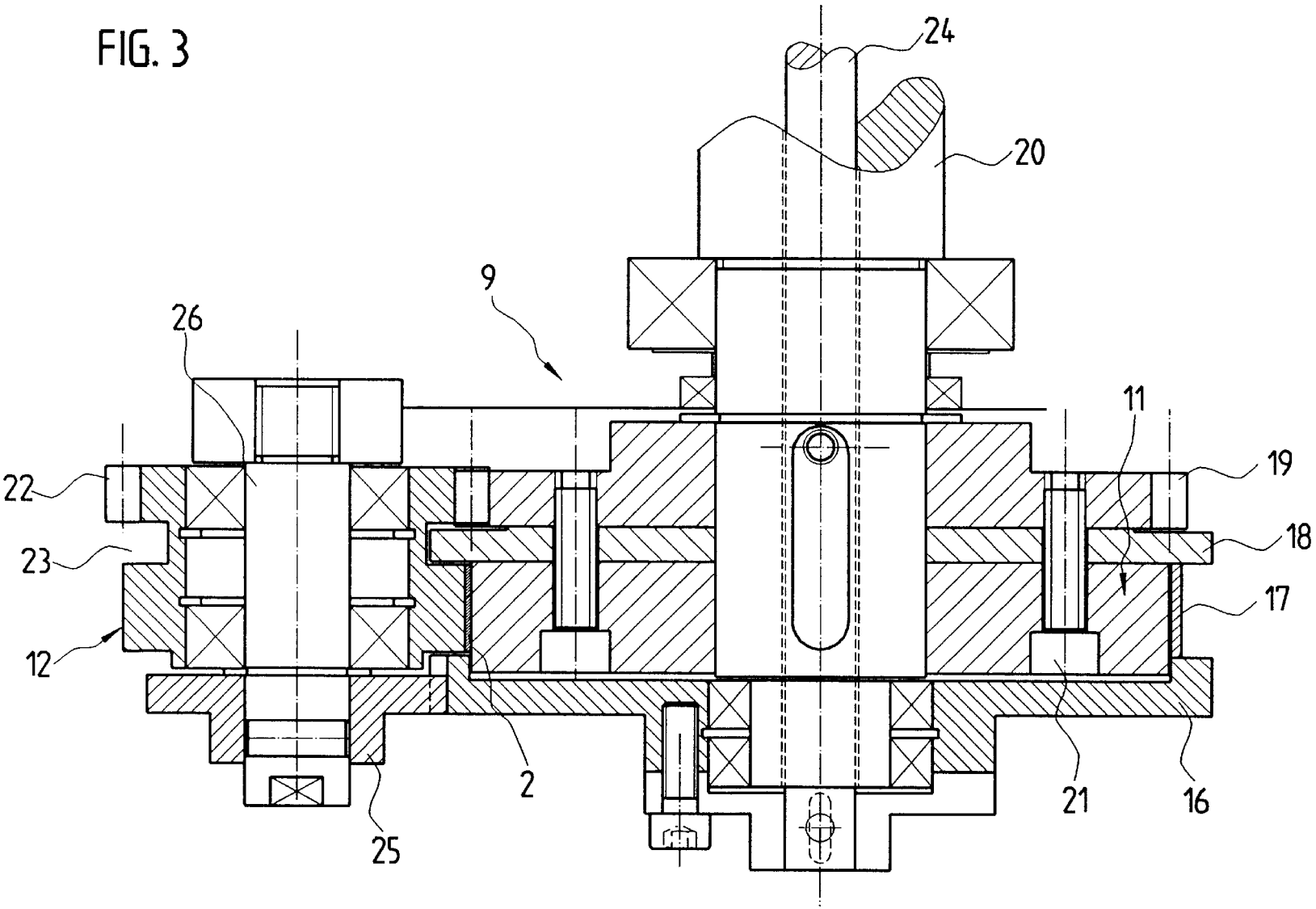
FIG. 3 shows the representation of the tensioning device of the machine sectioned along cutting line III—III in FIG. 2.

Tensioning device 9 according to the invention is shown enlarged in FIGS. 2 and 3. As shown therein, the tensioning device comprises a large tension roller 11 and a small pressing roller 12 which can be pressed against tension roller 11 by means of turning lever 14. Orthogonally running, essentially V-shaped grooves preferably are milled both in the peripheral surface of tension roller 11 as well as in the peripheral surface of pressing roller 12, so that small, pyramidal-shaped units are formed with rectangular base surfaces and sharp points. The friction surfaces structured in this way are preferably hardened, e.g., by plasma nitriding, thereby permitting the transmission of high tensile forces to strip 2. Strip 2 is wound around tension roller 11—proceeding from strip conveyor device 6—in an angular segment of more than 90° and then proceeds to sealing device 13 passing through strip channel 15.

FIGS. 2 and 3 show tensioning device 9 during the tensioning operation, in which strip 2 is clamped between tension roller 11 and pressing roller 12, and is drawn tightly around packing unit 28 as a result of tensioning device 9. Pressing roller 12 is pressed tightly against tension roller 11 by a drive device (not shown), so that strip 2 is clamped between the peripheral surfaces of both rollers 11 and 12.

As can be seen in FIG. 3, according to the invention, a cover disk 16, which bears a rejecter 17 formed as a cylindrical segment, is arranged coaxially to tension roller 11 and lying opposite its front surface. In order to improve clarity, cover disk 16 is not shown in FIG. 2, so that strip 2 running behind the cover disk and rejecter 17 can be viewed. Strip 2 is represented in the tensed state in FIGS. 2 and 3, i.e., it is clamped between the peripheral surfaces of tension roller 11 and pressing roller 12, thus, rejecter 17 is found on the right side turned away from pressing roller 12.

FIG. 3 shows that tension roller 11 with a guide disk 18 and a toothed wheel 19 is arranged on a common hollow shaft 20, which is motor driven, and is screwed with guide disk 18 and toothed wheel 19 by means of connection bolts 21. Toothed wheel 19 also engages with a segment of pressing roller 12 provided with an outer toothed piece 22, and guide disk 18 engages in a complementary groove 23 of pressing roller 12 between its friction surface and the segment with outer toothed piece 22. The line of action of outer toothed piece 22 and of toothed wheel 19 joined with tension roller 11 lies in the peripheral surface of tension roller 11, so that the drive acting on hollow shaft 20 (not shown) acts via the toothed piece on pressing roller 12 in such a way that the latter is moved without slipping up to strip 2 clamped between this pressing roller 12 and tension roller 11.

Figure 5:
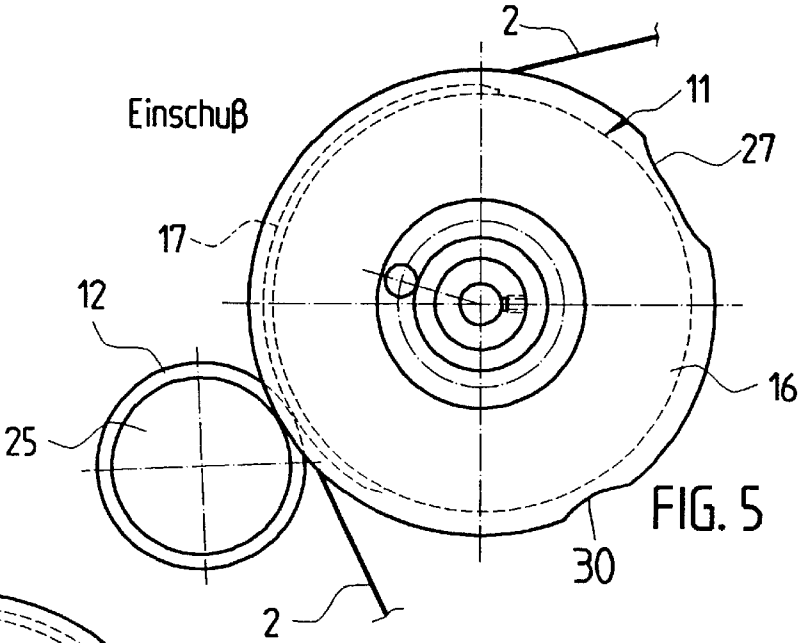
FIGS. 4–6 show the tensioning device according to the invention in three different operating states in front view.
Figure 4:
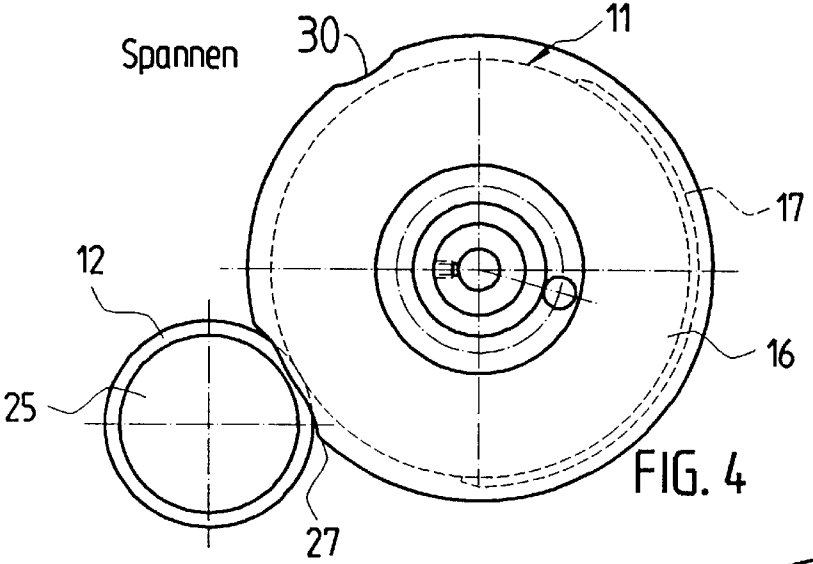

Cover disk 16 is mounted in a rotating manner relative to hollow shaft 20 and is thus decoupled from the drive of the tension roller. It is attached to a shaft 24 that can be driven separately and is arranged inside hollow shaft 20. Shaft 24 is driven with normal machine operation in such a way that cover disk 16 with rejecter 17 is moved from the tensioning position already described and presented in FIGS. 2, 3 and 4 into the shooting position represented in FIG. 5 and back again. In the shooting position, rejecter 17 is displaced approximately 180° in the peripheral direction to the tensioning position and essentially covers the angular region of tension roller 11, which strip 2 winds around. Strip 2 now slides over the surface of rejecter 17 which has a smooth sliding surface. In this way, the production of friction in the region of the contact between strip 2 and tension roller 11 is avoided. During the shooting and pullback steps, pressing roller 12 is turned away from tension roller 11, so that there is also no contact between strip 2 and the friction surface of pressing roller 12.

Figure 6:
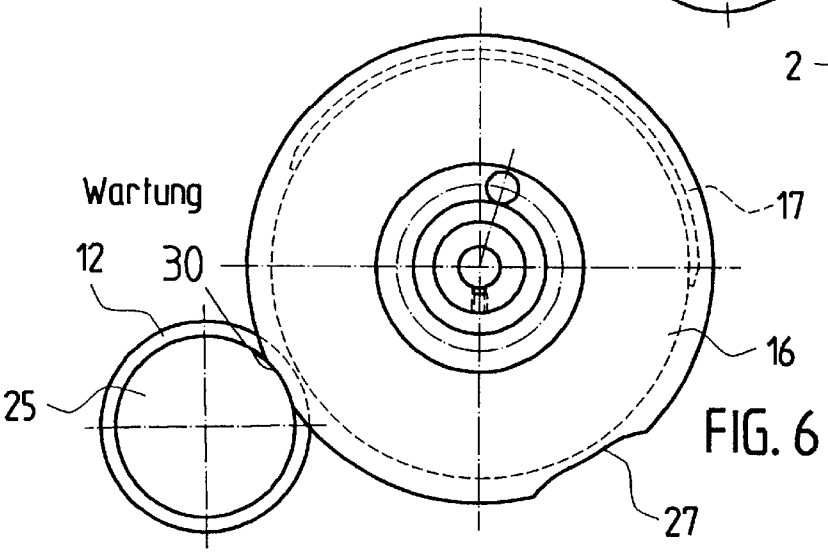

Another position of cover disk 16 is shown in FIG. 6, which is established during maintenance operations, and when there is no strip between tension roller 11 and pressing roller 12. It will be recognized that in this position, pressing roller 12 is not in contact with tension roller 11. An annular flange 25, which is attached to the free end of axle 26 bearing pressing roller 12, is applied in a flat recess 30 of the outer periphery of cover disk 16 of tension roller 11 shaped as a circular segment, whereby the peripheral surface of pressing roller 12 lies at distance of preferably between about 0.5 and 1.5 mm the peripheral surface of tension roller 11. In this way, the pyramidal-shaped projections on the peripheral surfaces of both rollers 11, 12 can be prevented from striking against each other and chipping. Thus, in maintenance operations with the machine opened, without the strip applied, the drive of turning lever 14 (FIG. 1) can be actuated without danger for pressing roller 12, whereby annular flange 25 of pressing roller 12 can be moved up to the stop in flat recess 30 of tension roller 11.

Except in the tensioning position (FIGS. 2–4), the outer diameter of cover disk 16 of tension roller 11 is enlarged in the total peripheral region such that a distance is maintained between the peripheral surface of pressing roller 12 and the closest lying surface of tension roller 11. As described, when annular flange 25 is engaged in flat recess 30 of the tension roller, a certain distance remains between both friction surfaces of tension roller 11 and pressing roller 12. In other angular positions, particularly the shooting position (FIG. 5), cover disk 16 has its maximal diameter, whereby strip 2 slides over the sliding surface of rejecter 17, and a small play remains between the strip and the friction surface of pressing roller 12. Finally, a deep recess 27 is provided at a position on the peripheral surface of cover disk 16, and annular flange 25 projects into this recess in the tensioning position, so that the outer surfaces of tension roller 11 and pressing roller 12 can be pressed against one another.

EQUIVALENTS

Those skilled in the art will recognize, or be able to ascertain many equivalents to the preferred embodiments described herein. Such equivalents are intended to be encompassed by the following claims.

What is claimed is:

1. A machine for tying up or hooping packing units with an elongated strip of binding material, said machine comprising:

a) supply means for supplying the elongated strip to a take-up device capable of conducting the strip into a conveyor device;

b) a tensioning assembly capable of receiving the strip from the conveyor device and conducting the strip into a guide which causes the strip to be looped around the packing unit; wherein said tensioning assembly comprises a tension roller having a high friction surface and a pressing device adapted to press the strip against the tension roller;

c) a sealing device for sealing the loop and d) at least one rejecter capable of being moved between the strip and the high friction surface of the tension roller.

2. The machine of claim 1, wherein the rejecter comprises a smooth sliding surface.

3. The machine of claim 1, wherein the rejecter comprises a cylindrical sleeve having an inner peripheral surface capable of encompassing the peripheral surface of the tension roller.

4. The machine of claim 1, wherein the rejecter is attached to a cover disk which is mounted in a rotatable manner coaxial to the tension roller, and which is capable of being driven by a rotating drive.

5. The machine of claim 1, wherein the strip is wound around an angular segment of the tension roller of approximately 90° and the rejecter extends over an angular segment of the cylindrical sleeve that is at least of equal magnitude.

6. The machine of claim 1, wherein the pressing device comprises a pressing roller capable of being moved into contact with the tension roller.

7. The machine of claim 1, further comprising a stop element which can be moved from a release position into a locked position, wherein in the locked position the stop maintains a gap between the surfaces of the pressing roller and the tension roller, and in the released position, permits unhindered pressing together of the surfaces of the tension roller and the pressing roller.

8. The machine of claim 7, further comprising means for controlling the stop.

9. The machine of claim 8, further comprising a cover disk wherein the stop element is formed by an enlarged outer diameter of the cover disk bearing the rejecter and the outer peripheral surface of the cover disk forms an abutment for a contact surface joining with the pressing roller.

10. The machine of claim 9, wherein the contact surface is formed by an outer peripheral surface of an annular flange arranged coaxially to the pressing roller.

11. The machine of claim 1, wherein the surface of the tension roller comprises pyramidal-shaped projections.

12. The machine of claim 1, wherein the high friction surface comprises a rubber material.

13. A tensioning assembly for a hoop-casing device comprising:

a) a tensioning assembly comprising a tension roller having a high friction surface adapted to engage an elongated strip of binding material, and a pressing device adapted to press the binding strip against the high friction surface of the tension roller; and b) a rejecter having a smooth sliding surface capable of being moved between the strip and the high friction surface of the tension roller.

14. The tensioning assembly of claim 13, wherein the high friction surface comprises a rubber material.

15. The tensioning device of claim 13, wherein the rejecter comprises a cylindrical sleeve.

16. The tensioning device of claim 13, wherein the rejecter is attached to a cover disk which is mounted in a rotatable manner coaxial to the tension roller, and which is capable of being driven by a rotating drive.

* * * * *